United States Patent [19]

Voss et al.

[11] Patent Number: 4,795,031

[45] Date of Patent: Jan. 3, 1989

[54] METHOD FOR PACKAGING PLAYING BALLS

[75] Inventors: Timothy R. Voss, Feeding Hills; John L. Doleva, Amherst, both of Mass.

[73] Assignee: Spalding & Evenflo Companies, Inc., Tampa, Fla.

[21] Appl. No.: 68,004

[22] Filed: Jun. 30, 1987

[51] Int. Cl.[4] ..... B65D 85/58

[52] U.S. Cl. ..... 206/315.9; 53/399; 53/442; 53/411; 156/86

[58] Field of Search ..... 53/399, 411, 442, 585; 206/315.9; 156/69, 86

[56] References Cited

U.S. PATENT DOCUMENTS

| | | | |
|---|---|---|---|
| 1,751,275 | 3/1930 | Gammeter . | |
| 3,386,371 | 5/1968 | Farmer et al. | 100/9 |
| 3,716,433 | 2/1973 | Plummer | 156/85 |
| 3,734,273 | 5/1973 | Watanabe | 206/46 FC |
| 3,829,348 | 8/1974 | Spiegel et al. | 161/16 |
| 4,054,474 | 10/1977 | Collins, III et al. | 156/86 |
| 4,225,049 | 9/1980 | Inoue | 215/12 R |
| 4,285,746 | 8/1981 | DePuy et al. | 156/79 |
| 4,336,087 | 6/1982 | Martuch et al. | 156/85 |
| 4,351,693 | 9/1982 | Fuller | 53/585 X |
| 4,491,494 | 1/1985 | Davis, Jr. et al. | 156/240 |
| 4,514,966 | 5/1985 | Konstantin | 53/585 |

FOREIGN PATENT DOCUMENTS

| | | | |
|---|---|---|---|
| 1386685 | 3/1975 | United Kingdom | 53/585 |

*Primary Examiner*—John Sipos

*Attorney, Agent, or Firm*—Donald R. Bahr; John E. Benoit

[57] ABSTRACT

A method for packaging a playing ball so as to provide a partially exposed surface of the ball which comprises the steps of imprinting selected indicia on a heat shrinkable plastic film loop, placing the loop about the ball in frictional contact with a portion of the surface of the ball, applying heat to the loop and the ball to shrink said loop so as to wrap a circumferential section of the ball, and removing the heat and permitting the loop to cool about the ball in its shrunken state. If the ball is partially deflated, the loop is placed about the ball and the ball is inflated until frictional contact between the ball and loop occurs with subsequent heat application.

11 Claims, 1 Drawing Sheet

METHOD FOR PACKAGING PLAYING BALLS

This application relates generally to methods for packaging playing balls for subsequent retail sale and, more specifically, to the use of a shrink wrap partially covering a playing ball.

When playing balls (such as basketballs, footballs, soccer balls, volley balls, and baseballs) are displayed in retail stores, it is necessary that they be packaged in a manner such that they may be handled by the prospective purchaser so that he may "feel" the ball's surface when he is holding it.

The common practice for packaging these balls is to place them in a cardboard container which has numerous openings so that the ball may be touched through the openings and so that the ball may be temporarily removed from the box to get an even better "feel" of the ball while holding or throwing it. In this type of mechandising, the pricing information is printed on the box and may include a universal code.

This concept depends upon the honesty of the consumer, assuming that he will place the ball back in the proper box. The normal custom is to provide the playing ball (such as the basketballs, footballs, soccer balls, volley balls, and softballs or baseballs) in various quality and price ranges. Unfortunately, this presents the opportunity for switching balls from one box to another. Since the price is normally on the box, either in a stamped or labeled fashion, or the box itself contains a labelling code, such dishonest procedure allows a person to obtain the best quality ball in a box of lesser quality. Thus, he does not pay the proper price for the ball.

The present invention provides a means for packaging a ball through a shrink wrap concept wherein the shrink wrap only partially covers the surface of the ball so as to permit handling of the ball and obtaining the "feel" of the ball. At the same time, the necessary pricing information (such as an actual price or a pricing code) is imprinted permanently in the shrink wrap. Accordingly, even though the balls may also be placed in a box, interchanging balls between boxes would no longer provide a means for obtaining a less expensive ball since the pricing code or pricing information is on the shrink wrap around the ball. This concept also permits the display of the balls in a storage bin without the added bulk and cost of a box.

With the shrink wrap concept, the plastic film loop, which is tightly wrapped around the ball while not adhesively held on the ball, cannot be removed from the ball without destroying the loop. Accordingly, such loops are not interchangeable.

The invention will be more clearly understood from the following description, taken together with the drawings.

SUMMARY OF THE INVENTION

The invention provides a method for packaging a playing ball so as to maintain a partially exposed surface of the ball which comprises the steps of imprinting selected indicia, including pricing information, on a heat shrinkable plastic film loop, placing the loop about the ball in frictional contact with a portion of the surface of the ball, applying heat to the loop and the ball to shrink the loop so as to wrap a circumferential section of the ball, and removing the heat and permitting the loop to cool about the ball in its shrunken state. If the ball is partially deflated, the loop may be placed about the ball with the ball then being inflated until frictional contact between the ball and the loop occurs. Heat is then applied, as discussed above. The heat causes a tight fit about the ball, but does not cause the loop to be adhesively held on the ball. It may be removed, however, only by destruction of the loop. This provides a wrapping about the ball having pricing information as well as identification while leaving a portion of the ball exposed so that the customer may get the feel of the surface of the ball. The heat shrunk loop cannot be removed without destroying the loop itself.

DESCRIPTION OF THE PREFERRED EMBODIMENTS

Figure 1:
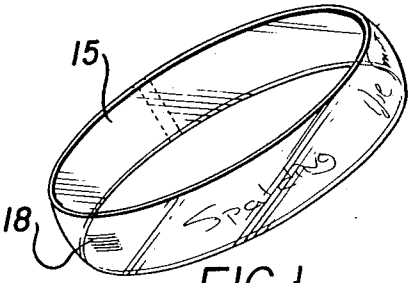
FIG. 1 is a perspective view of a plastic film loop having indicia thereon.

Turning now to the drawings, FIG. 1 discloses a film loop 15 having indicia thereon. This particularly includes the indicia of a pricing code such as the standard UPC code.

Figure 2:
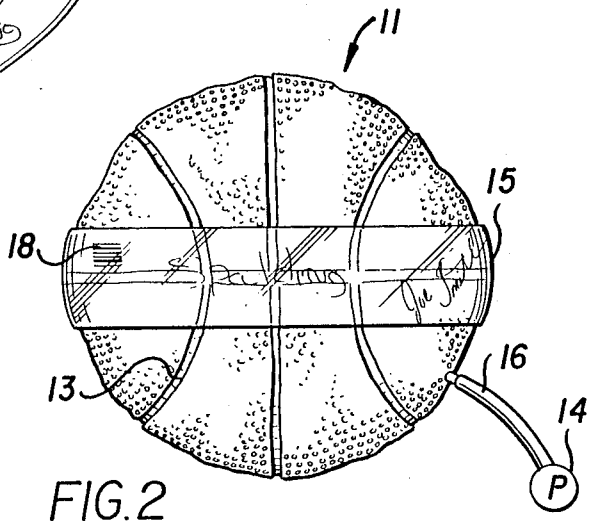
FIG. 2 is a plan view of a partially deflated basketball having the plastic loop placed thereabout.
Figure 3:
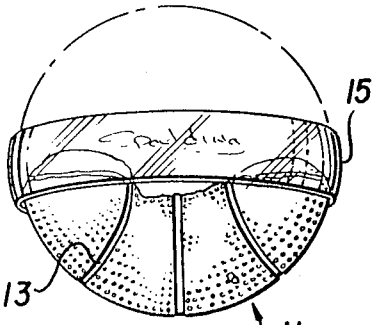
FIG. 3 is a view of an inflated basketball with the film loop in frictional contact with the surface thereof.

If the loop is to be used about a deflated or semi-deflated ball, it is placed about ball 11 as shown in FIG. 2 with a pump 14 attached to the ball by means of tubing 16. A basketball is shown having the usual seams 13. Basketball 11 is then inflated by pump 14 until it reaches its normal size. Loop 15 is dimensioned such that when the basketball reaches its fully inflated size, loop 15 will be in frictional contact with the surface of the ball. This condition is shown in FIG. 3. As will be evident, the loop 15 is frictionally held in place but is still removable without destroying it.

Figure 4:
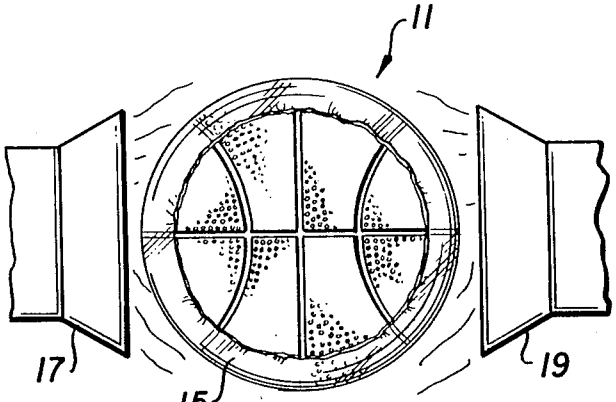
FIG. 4 is a plan view of the film loop being heated so as to cause it to shrink about the ball.

FIG. 4 illustrates the application of heat by means of heaters 17 and 19 which may be any type of heating device which is commonly used in the shrink wrap art. In the view shown in FIG. 4, loop 15 is in the process of shrinking so as to encompass a portion of the ball.

Because the band is being shrunk onto a spherical surface, the degree of shrinkage within the band varies. The maximum shrinkage occurs at the edges of the band as more shrinkage is required to bring the band in contact with the sphere's surface. At the center of the band the shrinkage is limited by the ball's diameter.

When a band having a width of approximately 3.3 inches and a diameter of 9.7 inches is applied on the center line of a basketball having a diameter of approximately 9.45 inches, the shrinkage is on the order of 7.7% to 9.5%.

Figure 5:
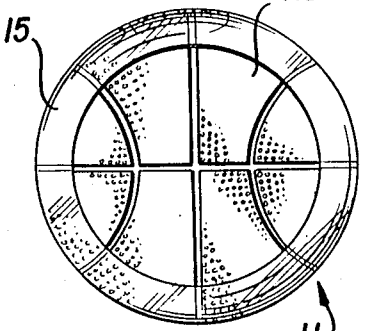
FIG. 5 is a view similar to FIG. 4, with the shrunken plastic loop in place about the ball.

FIG. 5 illustrates the finished product wherein loop 15 is securely wrapped about ball 11 and held there without the use of adhesive since the outer edges of the loop are now of a smaller diameter than the ball. This leaves an open area 11*a* so that the surface of the ball may be touched and felt by the prospective purchaser.

Figure 6:
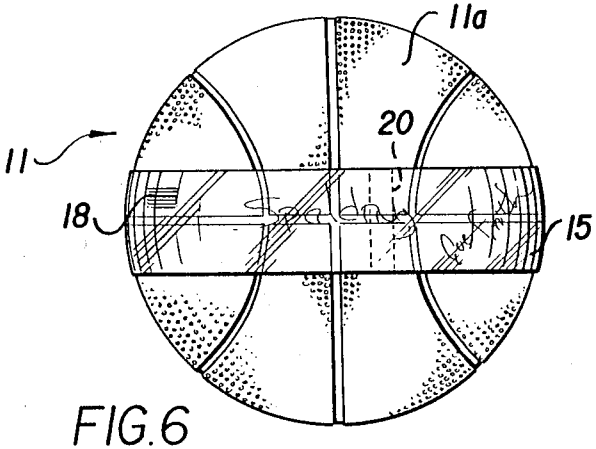
FIG. 6 is a side view of the ball of FIG. 5 showing the various indicia of the loop.

FIG. 6 is a side view of FIG. 5 specifically illustrating the indicia on the loop, including the pricing code 18. Also shown is seam 20, indicating the overlap of the loop created by attaching the ends of a strip to create the loop.

A preferred film utilized in this process is uniaxially oriented PVC film. This is a standard film used in heat shrinking, particularly when indicia is to be printed on or encompassed therein. Because the film is uniaxially oriented, there is less distortion of printed material after shrinkage.

It will be obvious that the ball, as shown in FIG. 6, may be displayed with no further wrapping or it may be placed in either a closed or open type box. Since the ball can be removed, it can be handled and touched by the prospective purchaser. The loop 15, however, cannot be removed without destroying the loop. Accordingly, if the ball were to b placed in a box in which it is not intended to be housed, and an attempt were to be made to purchase the ball, the pricing code 18 still remains on the ball itself and, therefore, the price for the ball cannot be changed.

Figure 7:
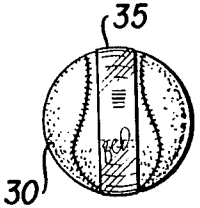
FIG. 7 illustrates a basball or softball having the heat shrunk loop thereabout.

FIG. 7 illustrates that the concept of this invention may be used on non-inflatable balls such as a baseball or softball 30. Again, film 35, including pricing code 36, is placed about the ball in the same manner as described hereinabove and heat treated so as to provide the necessary shrink wrap. As previously stated, the present invention may be used on any playing balls.

The above description and drawings are illustrative, only, since modifications may be made in the method of applying the loop without departing from the present invention, the scope of which is to be limited only by the following claims.

I claim:

1. An article of manufacture comprising a substantially spherical playing ball;

a substantially flat plastic loop non-adhesively heat shrunk about a circumferential section of said ball so that the entire surface of said loop is retained against said ball, the width of said plastic loop being substantially less than the circumference of said ball; and permanent indicia including pricing information imprinted on said plastic loop;

said loop being non-removable without destruction of

2. The article of claim 1 wherein said plastic loop comprises a heat shrinkable uniaxially oriented PVC film.

3. The article of claim 1 wherein said playing ball is inflatable.

4. A method for packaging a portion of a playing ball which comprises the steps of imprinting selected indicia, including a pricing code, on a heat shrinkable plastic film loop of predetermined size;

placing said loop about a portion of a playing ball in frictional contact with the surface of the ball;

applying heat to said loop and said ball to shrink said loop so as to wrap a circumferential section of said ball, the arc of said loop being non-adhesively frictionally secured to said ball over the entire area of said loop; and removing said heat so as to permit said loop to cool about said ball in its shrunken state;

whereby said loop is non-removable without destruction of the loop.

5. The method of claim 4 wherein said ball is a basketball.

6. The method of claim 4 wherein said ball is a baseball.

7. The method of clam 4 wherein said heat shrinkable plastic film is uniaxially oriented PVC film.

8. The method of claim 4 wherein said heat shrinkable film loop is of a dimension before shrinking such that it is frictionally retained on said ball.

9. A method for packaging a portion of an inflatable playing ball which comprises the steps of imprinting selected indicia, including a pricing code, on a heat shrinkable plastic film loop of predetermined size;

placing said loop about a deflated or partially inflated playing ball;

inflating said ball to a size whereby said loop is frictionally held by said ball;

applying heat to said ball and said loop to shrink said loop so as to wrap a circumferential section of said ball; and removing said heat so as to permit said loop to cool about said ball in its shrunken state.

10. The method of claim 9 wherein said ball is a basketball.

11. The method of claim 9 wherein said heat shrinkable plastic film loop is uniaxially oriented PVC film.

* * * * *